United States Patent [19]

Verclyte

[11] Patent Number: 4,905,740

[45] Date of Patent: Mar. 6, 1990

[54] DEVICE FOR FORMING A SELVEDGE ON A CLOTH ON WEAVING MACHINES

[75] Inventor: Eddy Verclyte, Ypres, Belgium

[73] Assignee: Picanol N.V., Ypres, Belgium

[21] Appl. No.: 288,229

[22] Filed: Dec. 22, 1988

[30] Foreign Application Priority Data

Dec. 22, 1987 [BE] Belgium ..... 8701467

[51] Int. Cl.[4] ..... D03D 47/48

[52] U.S. Cl. ..... 139/434

[58] Field of Search ..... 139/429, 430, 434

[56] References Cited

U.S. PATENT DOCUMENTS 3,951,177 4/1976 Santucci ..... 139/434

4,142,559 3/1979 Sbabo ..... 139/434

FOREIGN PATENT DOCUMENTS 676282 3/1966 Belgium .

2505885 11/1982 France .

OTHER PUBLICATIONS

English language Abstract of Belgium Published Specification No. 893.142, 8/30/82.

*Primary Examiner*—Henry S. Jaudon

*Attorney, Agent, or Firm*—Bacon & Thomas

[57] ABSTRACT

A device for forming a selvedge on a cloth on weaving machines, of the type which consists of at least one mechanism (8, 9, 10) for forming one or more selvedges (4, 5, 6, 7), where tucking in the thread ends (42, 43) of the cloth or cloths (2, 3) is done by means of components (34) mounted above the cloth (2, 3) or above the warp thread (12), and where said mechanism (8, 9, 10) has a drive (58) situated partly above and partly below the plane of the cloth (2, 3), is characterized in that the mechanism (8, 9, 10) for forming a selvedge (4, 5, 6, 7) comprises at least two connected, dismountable parts, namely a bottom part (54) and a top part (55) respectively, where said bottom part (54) is situated entirely below the plane in which the cloth (2, 3, 72) is located.

4 Claims, 5 Drawing Sheets

IV
V
IV
V
IV

VI
58
1
34
10
36
55
41
61
44
62
60
38
67
59
12
63
12
13
18
20
2
40
53
53
54
11
50
52
VI
31
32
51
52
17
56
57

1
10
55
34
36
37
44
41
60
E
64
5
65
59
6
61
13
12
65
2
3
53
53
68
69
32
31
52
54
57
56
66
52
17

DEVICE FOR FORMING A SELVEDGE ON A CLOTH ON WEAVING MACHINES

BACKGROUND OF THE INVENTION

This invention concerns a device for forming a selvedge on a cloth on weaving machines.

DESCRIPTION OF THE RELATED ART

It is known that when a cloth is formed on a weaving machine, selvedges may or may not be made. In order to produce a cloth with selvedges, mechanisms are mounted on the weaving machine, by means of which, after a weft thread has been bound in by the warp threads, the leading end of the weft thread may be bent over and tucked back into the shed, so that it is bound in with the next weft thread.

For this purpose, mechanisms can be used which have at least one thread clip by means of which such a leading end may be gripped, and a swivel-mounted, needle-shaped thread tucker which is inserted through the top warp sheet part-way into the shed, and which then grips the weft thread end held in the thread clip and as a result of its backward motion draws the weft thread end into the shed. Such a mechanism is known for example from Belgian patent No. 893.142.

It is also known that more than two mechanisms for forming a selvedge can be mounted on a weaving machine, depending on the number of cloths produced side by side on the same weaving machine. Selvedge mechanisms mounted between two cloths are normally tandem units, i.e. they have two needle-shaped thread tuckers which can operate respectively on the adjacent edges of the two cloths between which the mechanism is mounted.

It is known that such mechanisms for forming selvedges, and also a number of other components of the weaving machine, for example the cloth support, the device for evacuating thread waste, the weft cutter and, in the case of rapier weaving machines the thread presentation device, to be mounted on a crossbar which extends across the width of the weaving machine at a short distance from the fell line underneath the cloth. In this crossbar there is a hollow in which a drive shaft is mounted, where said drive shaft is coupled to the main drive of the weaving machine and provides the drive for the above-mentioned components. For this purpose, said drive shaft extends through the housings of the mechanisms for forming the selvedges and also has bearings in said mechanisms. A major problem in such a construction is that when either switching to producing a cloth with a different width or switching from different cloths side by side to weaving a cloth which extends over the whole weaving width or vice versa, the above-mentioned components have to be dismounted and then mounted again, which takes a great deal of time and trouble. In order for a selvedge-forming mechanism, which is mounted or has to be mounted in the middle of the weaving width, to be removed or mounted on the weaving machine, a number of other components mounted on the crossbar have to be undone and removed, so that the mechanism in question can be slid over the above-mentioned drive shaft.

SUMMARY OF THE INVENTION

The present invention therefore has as its object a device for forming a selvedge on the cloth on weaving machines, which avoids the problems outlined above.

For this purpose, the invention concerns a device for forming a selvedge on a cloth, of the type consisting of at least one mechanism for forming one or more selvedges, where tucking in the thread ends of the cloth or cloths is done by means of components which are mounted above the cloth or warp threads, and where the mechanism includes drives which are mounted partly above and partly below the plane of the cloth, characterized in that the selvedge-forming mechanism comprises at least two connected, dismountable parts, namely a top and a bottom part respectively, where the bottom part is entirely below the plane of the cloth. If a selvedge-forming mechanism has to be removed, it is then sufficient to dismount the top part. The bottom part, which is entirely below the plane of the cloth, does not form any hindrance to producing a cloth which extends across the full weaving width.

In the preferred embodiment of the device, said bottom part consists of a housing in which a first, driven coupling component is located, while the top part similarly consists of a housing containing a second coupling component, which operates with the first coupling component as a result of the housings fitting on one another, and which also provides the drive for the movement of various parts of the mechanism; where each housing has an opening through which said coupling components can be coupled together. The coupling components preferably comprise gears. In the bottom housing, oil is preferably supplied in order to lubricate the coupling. In order to prevent the oil from contaminating the cloth in the dismounted state, and to prevent the oil being contaminated by the cloth, the device has a cover by means of which said bottom part can be isolated.

BRIEF DESCRIPTION OF THE DRAWINGS

In order to describe the characteristics of the device according to the invention, by way of example only and without being limitative in any way, the following preferred embodiment is described, with reference to the accompanying drawings, where.

DETAILED DESCRIPTION OF THE PREFERRED EMBODIMENTS

Figure 1:
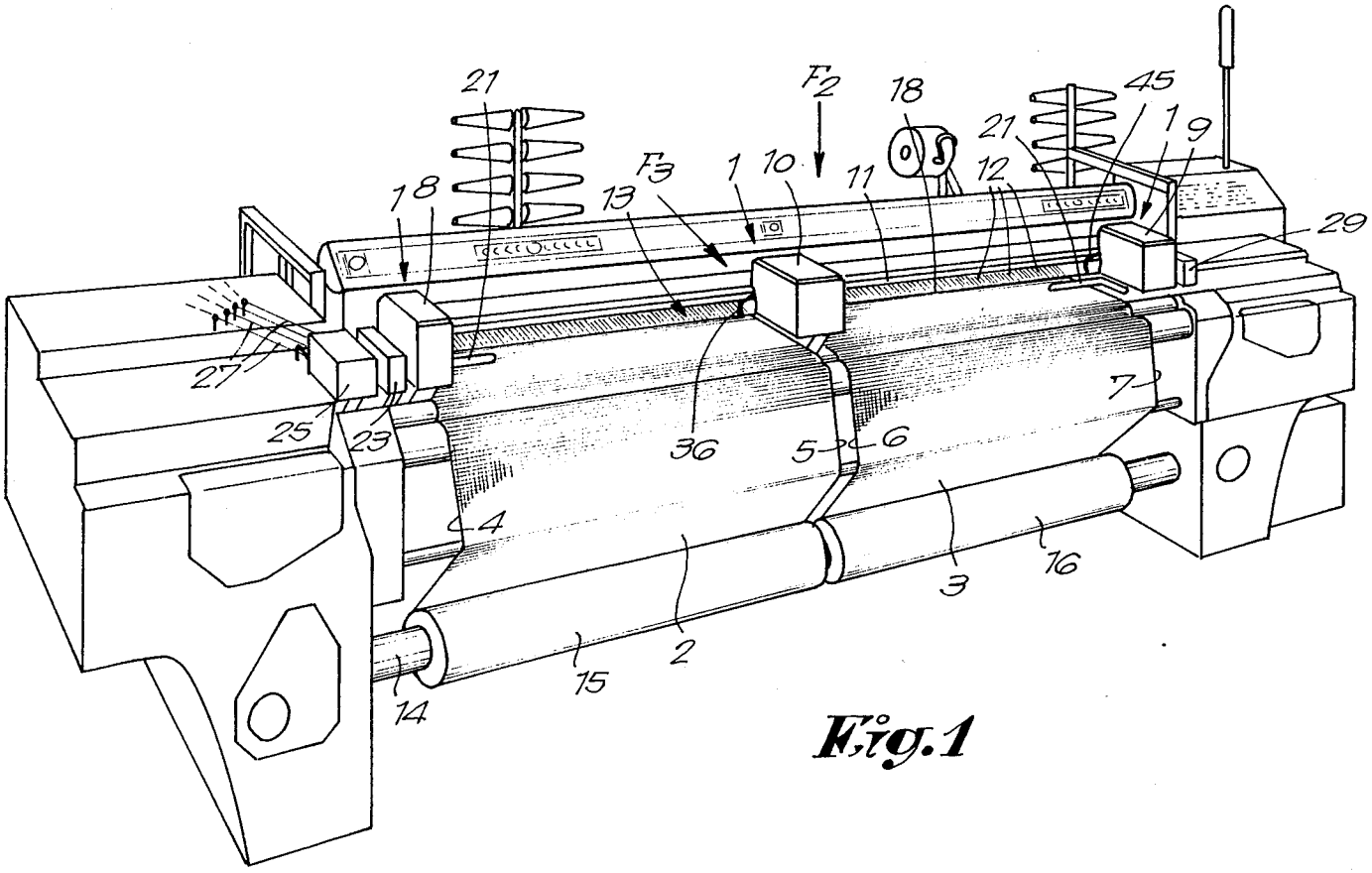
FIG. 1 is a schematic representation of a weaving machine fitted with a device according to the invention.

FIG. 1 shows a weaving machine on which a device 1 according to the invention is mounted. In the embodiment shown, two cloths 2 and 3 are produced side by side on the weaving machine. Said cloths 2 and 3 have selvedges 4-5 and 6-7, respectively. In order to obtain these selvedges, said device 1 includes three mechanisms 8 to 10 for forming selvedges. The mechanisms 8 and 9, which are mounted on opposite sides of the weaving machine, are of the single type, i.e. they form only one selvedge, namely the selvedges 4 and 7 respectively. The mechanism 10 which is mounted between the mechanisms 8 and 9 is preferrably of the double type, i.e. said mechanism 10 is constructed in such a way that it can form the two selvedges 5 and 6 respectively on the neighbouring edges of the two cloths 2 and 3 produced side by side. If more than two cloths are woven side by side, then several mechanisms 10 will be mounted along the weaving width.

For the sake of clarity, FIG. 1 also shows the reed 11, the warp threads 12 which form the shed 13, the cloth beam 14 and the cloth rolls 15 and 16 formed on said cloth beam 14.

Figure 2:
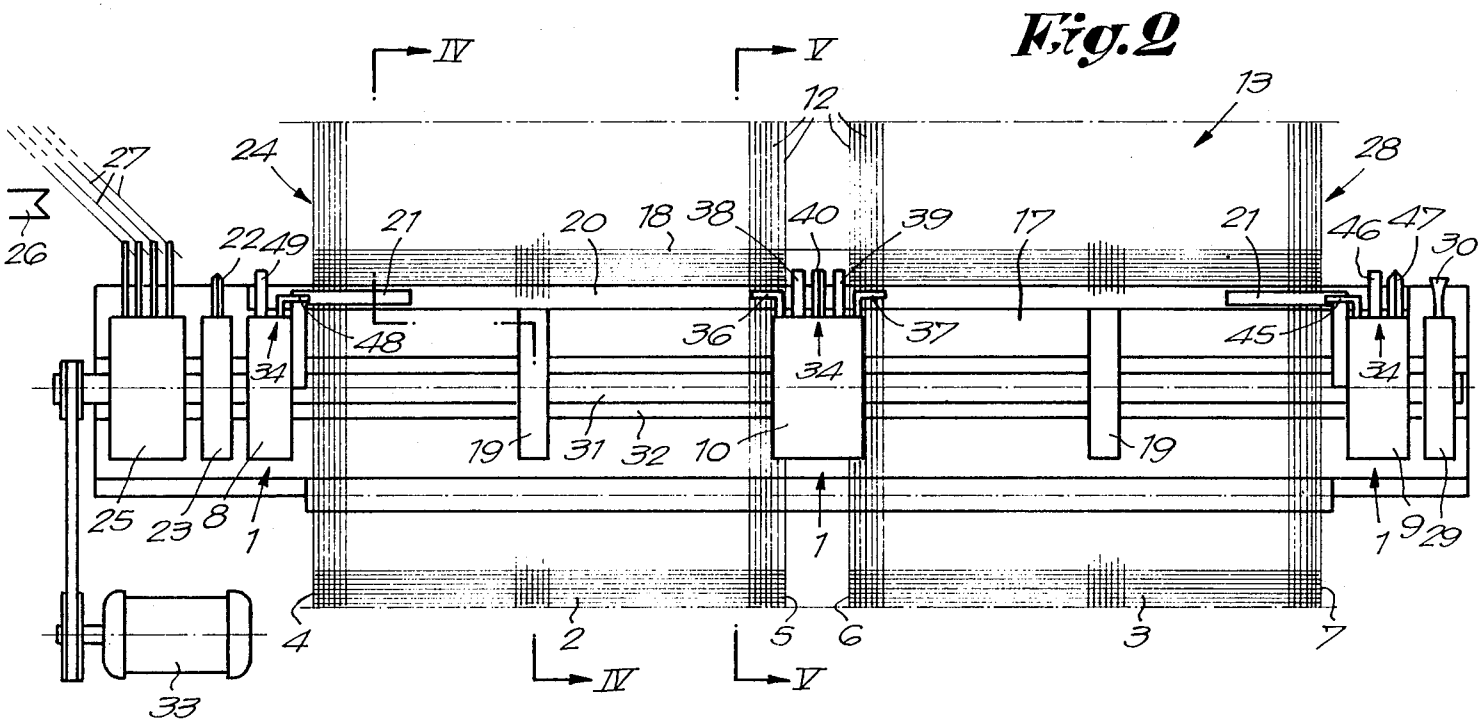
FIG. 2 shows a view in the direction of arrow F2 in FIG. 1.

As shown schematically in FIG. 2, the mechanisms 8 to 10 for forming the selvedges 4 to 7, together with a number of other components, are mounted on a crossbar 17 of the weaving machine frame, situated at a small distance from the fell line 18, parallel to the width of the shed 13, underneath the plane of the woven cloth, and more particularly underneath the cloths 2 and 3. Other components which can be mounted on the crossbar 17 are for example the supports 19 which carry the cloth support 20, on which in turn are mounted the temples 21, the weft cutter 22 and its drive mechanism 23, and in the case of a rapier weaving machine a device 25, mounted in front of the insertion side 24 of the shed 13, for correctly presenting the weft threads 27 to the insertion rapier 26, and, mounted at the receiving side of the shed 13, a mechanism for removing thread waste, for example by means of a suction nozzle 30. The moving parts are driven in a known way by means of a drive mechanism, also mounted underneath the plane of the cloth or of the cloths 2-3, which for example consists of a drive shaft 31 which is mounted in a recess or hollow 32 in the crossbar 17, where said drive shaft 31 is coupled to the drive 33 of the weaving machine, as shown schematically in FIG. 2. In this configuration, the mechanisms 8 to 10, the drive mechanism 23 and the device 25 can be synchronized with the drive 33 of the weaving machine, independently of each other.

Figure 3:
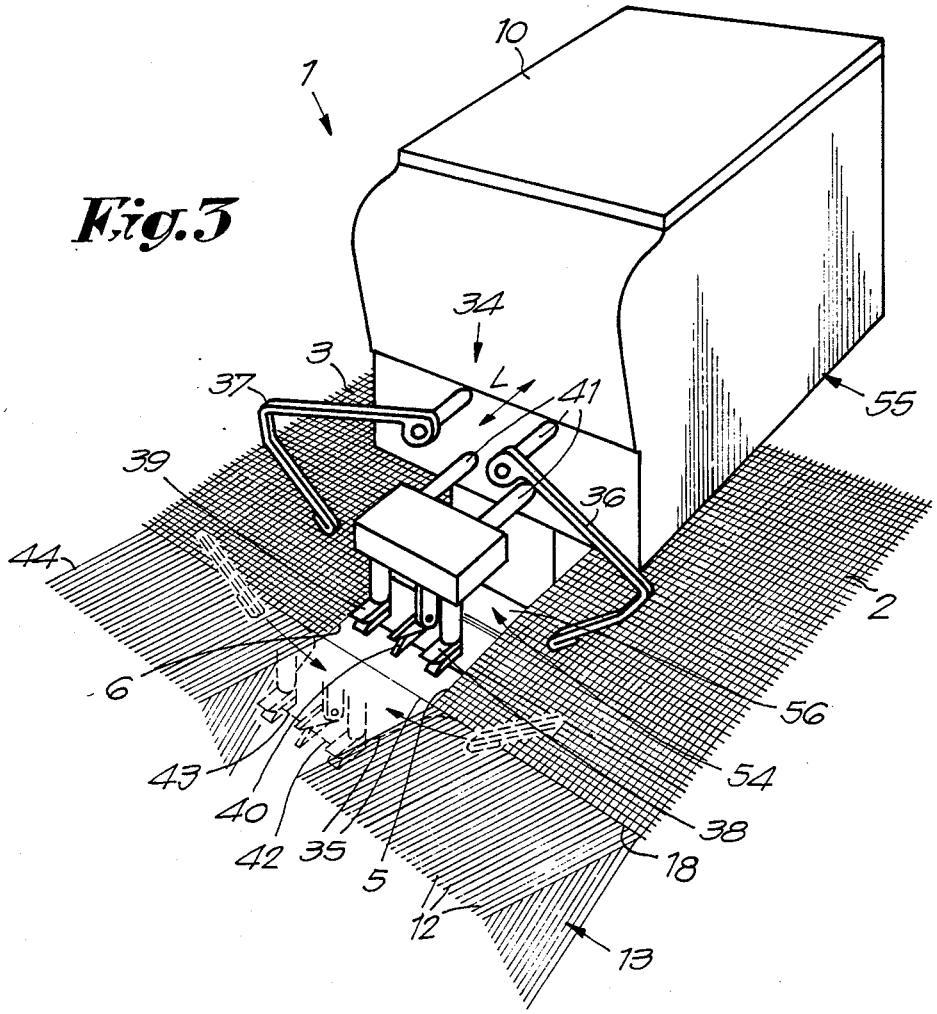
FIG. 3 shows a view in the direction of arrow F3 in FIG. 1.

In order to make the complete configuration clearer, FIG. 3 shows a perspective view of the double-type mechanism 10. The mechanism is mounted close to the fell line 18 and has a number of components 34 for handling the inserted weft threads 35, such that the selvedges 5 and 6 are formed on the corresponding cloths 2 and 3. The components 34 comprise, for example, as is known from Belgian patent No. 893.143, two swivel-mounted, needle-shaped thread tuckers 36 and 37, two thread clips 38 and 39 and a cutting mechanism such as a cutter 40 mounted between the thread clips 38 and 39.

All the components 34 can be moved in a direction L, transversely with respect to the weft direction, for example by means of rods 41, such that all these components 34 can be positioned in front of the fell line 18, as shown in solid lines, or behind the fell line 18, as shown in dotted lines. The operation of the mechanism 10, more particularly the cycle carried out by the components 34, is itself known, but for the sake of clarity it is described briefly below.

During insertion of a weft thread 35 into the shed, the components 34 are in their forward position, i.e. in the position shown in solid lines. In this position the needle-shaped tuckers 36 and 37 are swivelled upwards. When the weft thread 35 is beaten up, it comes into the position shown by the solid line in FIG. 3. After the reed has moved back, the thread 35 is bound in by the change-over of the warp threads 12 in the known way. Subsequently, said components 34 are moved back behind the fell line 18, such that the weft thread 35 is carried with them into a position as shown by the dotted line and gripped between the thread clips 38 and 39. The thread 35 is here cut by means of the cutter 40, so that two thread ends 42 and 43 are formed. Meanwhile, the needle-shaped tuckers 36 and 37 are swivelled towards each other through the top warp sheet 44 into the shed 13, until they grip the thread ends 42 and 43 presented between the fell line 18 and the thread clips 38 and 39, after which they tuck said thread ends into the shed 13 as a result of their return movement. As a result, said thread ends are bound in when the next binding is made.

The mechanisms 8 and 9 for forming the selvedges 4 and 7, mounted on either side of the weaving machine, are constructed in a similar manner. Clearly however, the mechanism 7 mounted at the receiving side 28 of the shed 13 has only one thread tucker 45, one thread clip 46 and one cutter 47. The mechanism 8 mounted at the insertion side 24 only has to have one needle-shaped thread tucker 48 and one thread clip 49. The weft cutter 22 can be used as the cutter necessary to cut the inserted thread ends to an even length.

Figure 4:
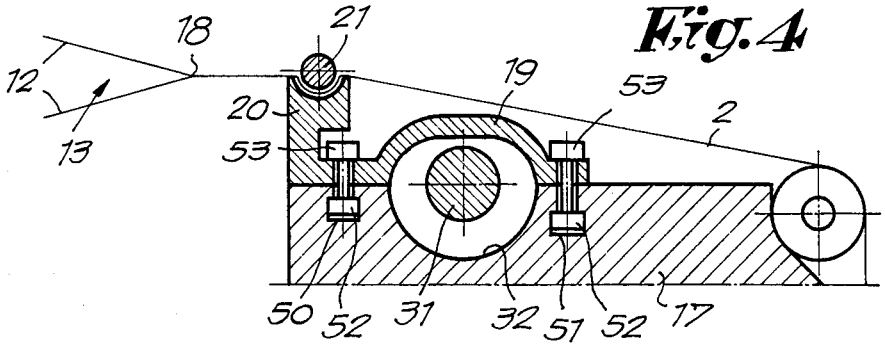
FIG. 4 shows a cross-section along line IV—IV in FIG. 2.
Figure 5:
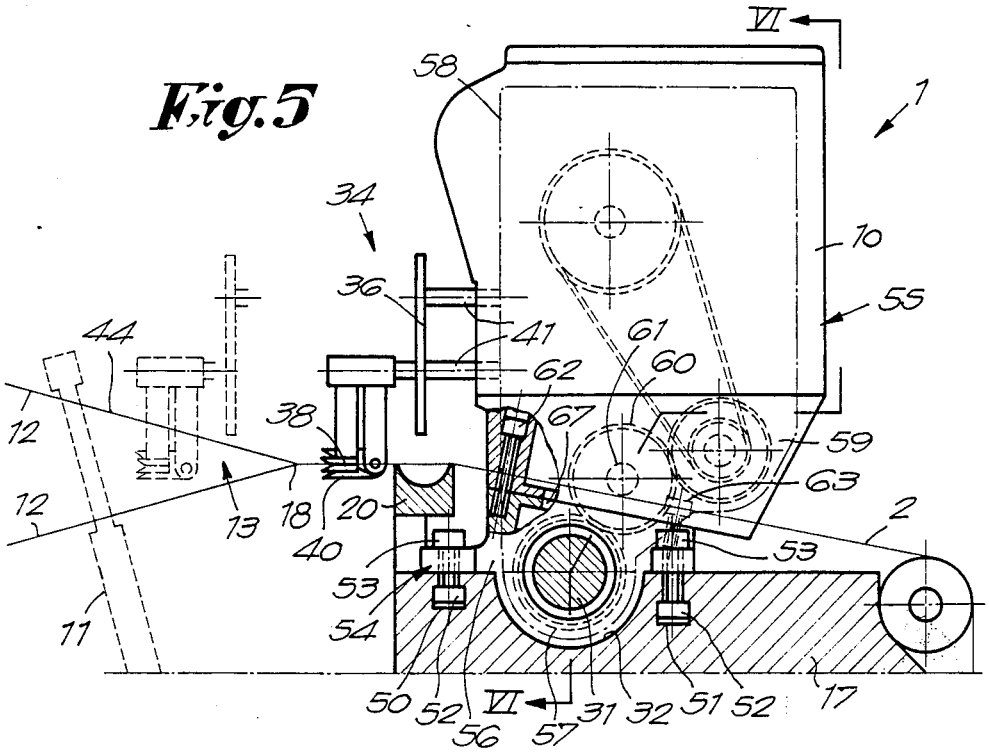
FIG. 5 shows a cross-section along line V—V in FIG. 2.

In order for the various components to be mounted on the crossbar 17, it is known for there to be inverted T-shaped slots 50 and 51 on the opposite sides of the hollow 32, for example as shown in FIGS. 4 and 5. The various components, such as for example the supports 19 and the selvedge mechanism 10 shown in side view in FIGS. 4 and 5, are mounted on the crossbar 17 by means of mounting brackets 52 which are inserted into the slots 50 and 51 and which operate with screws 53, preferably cylinder-head screws.

A special feature of the invention is that the selvedge mechanisms 8 to 10, and in particular the selvedge mechanism 10 which is mounted in the middle of the weaving width, can be dismounted simply, for example in order to produce a cloth over the full width of the weaving machine, without other parts having to be dismounted in order to enable said mechanism 10 to be removed. According to the invention, in order to achieve this goal, the device for forming a selvedge on a cloth includes one or more selvedge mechanisms 8 to 10 which, as shown in FIG. 5 for the mechanism 10, comprise at least two connected, dismountable parts, namely a bottom part 54 and a top part 55, where said bottom part 54 is situated entirely below the plane of the cloth or of the cloths 2-3.

The bottom part 54 of the above-mentioned mechanism 10 preferably includes a housing 56 in which is fitted a first, driven coupling component 57 of the drive 58 of the mechanism 10, while the top part 55 includes a housing 59 which contains a second coupling component 60 of the drive 58, where said second coupling component 60 operates with the first coupling component 57 as a result of the two housings 56 and 59 being mounted on each other, and where said second coupling component 60 also provides the drive for the above-mentioned components 34 of the mechanism 10. With the exception of the coupling components 57 and 60, the drive 58 of the mechanism 10 for forming selevedges is only shown schematically, since further description of the construction of the same is not important for one of ordinary skill in the art to understand the invention and can be accomplished according to any known principle.

Figure 6:
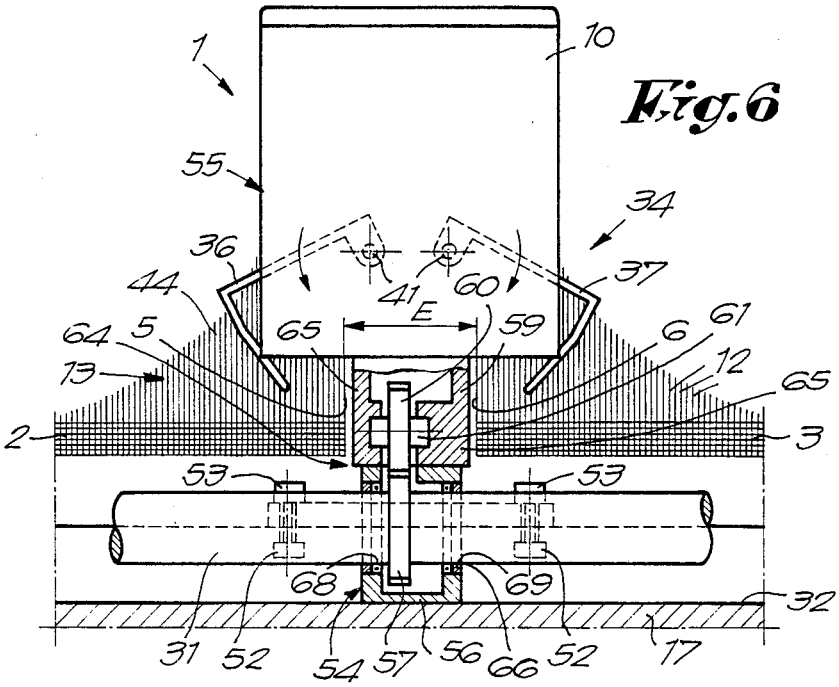
FIG. 6 shows a cross-section along line VI—VI in FIG. 5.

As also shown in FIG. 5, and also in FIG. 6, the coupling components 57 and 60 consist of meshing gears mounted respectively on the above-mentioned drive shaft 31 and on an axle 61 mounted in the housing 59.

The two housings 56 and 59 are mounted together by means of e.g. screws, preferably cylinder-head screws 62 and 63.

The above-mentioned mechanisms for mounting between two cloths 2 and 3, for example the above-mentioned mechanism 10, preferably have a top part 55 with a narrow base 64, such that the distance E between the cloths 2 and 3 passing on either side is kept to a minimum, as shown in FIG. 6. In order to achieve this, the base 64 preferably consists of only of the walls 65 and the second coupling component 60 necessary for the transmission so that the transverse dimension of base 64 essentially corresponds with "E".

Figure 7:
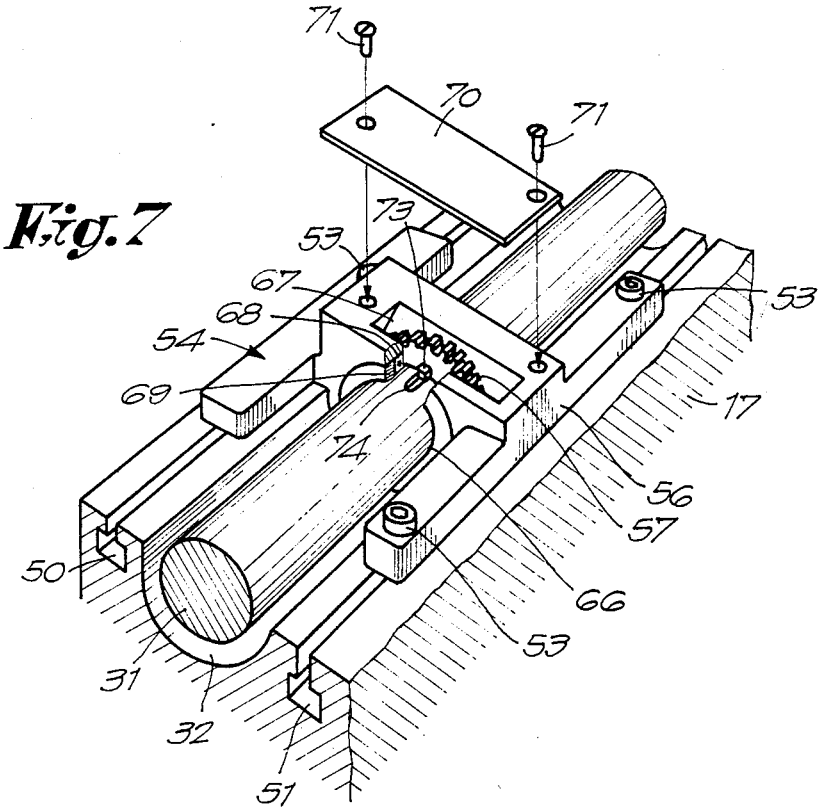
FIG. 7 is a perspective view of the bottom part of a selvedge-forming mechanism according to the invention.
Figure 8:
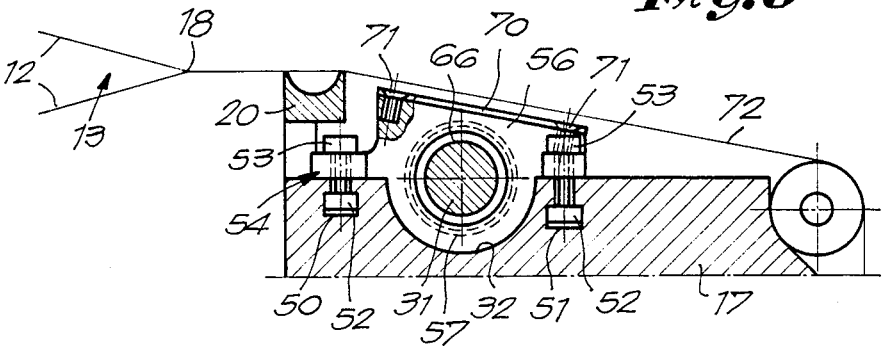
FIG. 8 shows a similar view to that of FIG. 5, but of the device in the dismounted state.

As shown in FIG. 7, the housing 56 of the bottom part 54 is almost completely enclosed, with the exception of the passage 66 for the drive shaft 31 and the opening 67 through which the second coupling component 60 can mesh with the first coupling component 57. In the housing 56 are also mounted bearings 68 to support the drive shaft 31. Also, oil-tight seals 69 are fitted on the passages 66 such that the housing 59 can be filled with oil in order to lubricate at least the coupling components 57 and 60 and possibly also other components of the drive mechanism 58. The almost completely enclosed construction of the embodiment according to FIG. 7 enables the bottom part to be completely enclosed when the top part 55 is dismounted, by fitting a cover on the top of the housing 56. More particularly, the bottom part may be enclosed by fitting, e.g. a cover plate 70 over the opening 67, by means of screws 71, for example. Here it is important for the bottom part 54 to be made in such a way that it remains situated below the plane of the cloth, even when the cover 70 is fitted. In this way, as shown in FIG. 8, a cloth 72, which for example is produced over the whole weaving width, can pass freely over the bottom part 54 and the cover 70.

In order to prevent the cloth 72 from catching or being damaged, the cover plate 70 preferably has a smooth top, and the screws 71 used in said cover plate 70 preferably have countersunk heads.

By using the cover 70, even when the corresponding mechanism 8 to 9 is dismounted, the oil can remain in the housing 56 without any risk that the cloth 72 moving over it will be contaminated. Also, the cover 70 prevents weaving dust from getting into the oil during the weaving process. To this end, a sealing ring can be fitted underneath the cover 70.

According to the invention several of the above-mentioned bottom parts 54 can be mounted on the crossbar 17, such that depending on the width of the cloth or cloths to be produced the top part 56 of the mechanism 10 and/or of the mechanism 9 can be mounted as required. An important feature is that the top part of the mechanism 9 normally mounted on one side of the weaving machine can also be moved simply, according to the width of the cloth.

As shown in FIG. 7 the first coupling component 57 is preferably fixed on the drive shaft 31 by means of a cotter 73. The keyway 74 for the cotter 73 in the drive shaft 31 can be situated locally if it is known which weaving width must be taken into account. In a more universal embodiment, a keyway 74 can be used which extends along the full length of the drive shaft 31, such that the bottom part 54, and consequently the top part 55 of the mechanism 10 mounted on said bottom part 54, can be mounted at any desired point on the crossbar 17.

The first coupling element 57 can also be attached by clamping. For this purpose, a gear 57 with a hub which can be compressed radially and which can be tightened round the drive shaft 31 by means of a clamping ring can for example be used.

Finally it should be noted that on known devices the weft cutter 22 mounted at the insertion side 24 on the crossbar 17 and the mechanism 8 form a single unit. When working without selvedges, said mechanism is removed completely and a separate weft cutter is fitted instead. A special aspect of the present invention is that the cutter 22 and its drive 23 are mounted on the crossbar 17 completely independently of said mechanism 8, as already described with reference to FIG. 2. Since said mechanism 8 is made in two parts, there is the special advantage that if no selvedges are required, the top part of the selvedge mechanism can simply be dismounted while the cutter 22 remains unaltered in place, without a separate cutter having to be mounted once more.

The present invention is not limited to the embodiment described by way of example and shown in the drawings; on the contrary, such a device for forming one or more selvedges on a cloth or cloths on weaving machines can be made in different forms and variants while still remaining within the scope of the invention.

I claim:

1. A device for forming a selvedge on a cloth on a weaving machine, comprising:

means for forming a selvedge;

first drive means, disposed above the plane of said cloth, for transmitting actuation motion to said selvedge forming means, said first drive means comprising first coupling means;

second drive means disposed below the cloth plane for driving said first drive means, said second drive means comprising a housing having an opening and second coupling means for transmitting actuation motion to said first coupling means via said opening when said first and second drive means are coupled to each other in driving relationship, said first and second drive means arranged to be selectively coupled to and decoupled from each other; and cover means for covering said opening of said second drive means when said first and second means are decoupled.

2. A device for forming a selvedge on a cloth on a weaving machine as claimed in claim 1, wherein said weaving machine is arranged to weave and form selvedges on each of two cloths arranged in side by side manner and separated by a space of predetermined distance, and wherein said housing is arranged to enclose, at least in part, said first coupling means in the separation space formed between said cloths, said housing having a transverse dimension extending across said space, said transverse dimension corresponding approximately with said predetermined distance.

3. A device as claimed in claim 1, wherein said weaving machine is arranged to form a selvedge on a plurality of cloths, and wherein said second drive means further comprises a drive shaft means for supplying actuation motion to said second coupling means, said drive shaft means extending beneath each of said cloths, and wherein said first and second coupling means comprise gears.

4. A device for forming a selvedge on a cloth on a weaving machine as claimed in claim 3, wherein said plurality of cloths includes two cloths arranged in side by side manner and separated by a space of predetermined distance, and wherein said second drive means includes a housing arranged to enclose, at least in part, said first coupling means in the separation space formed between said cloths, said housing having a transverse dimension extending across said space, said transverse dimension corresponding approximately with said predetermined distance.

* * * * *